US005421969A

United States Patent [19]

Kato et al.

[11] Patent Number: 5,421,969

[45] Date of Patent: Jun. 6, 1995

[54] SURFACE-TREATED STEEL SHEET HAVING IMPROVED WELDABILITY AND PLATING PROPERTIES, AND METHOD FOR PRODUCING THE SAME

[75] Inventors: Chiaki Kato; Yasuji Uesugi; Nobuyuki Morito; Akira Yasuda; Kouichi Yasuda; Hajime Kimura, all of Chiba, Japan

[73] Assignee: Kawasaki Steel Corporation, Kobe, Japan

[21] Appl. No.: 219,136

[22] Filed: Mar. 29, 1994

Related U.S. Application Data

[62] Division of Ser. No. 658,084, Feb. 20, 1991, Pat. No. 5,326,648.

[51] Int. Cl.[6] ..... C23C 14/02; C25D 9/02

[52] U.S. Cl. ..... 205/152; 205/177; 205/227; 205/244; 205/255; 205/917; 205/155; 427/376.8; 427/433

[58] Field of Search ..... 205/177, 227, 244, 255, 205/917, 152, 155; 427/376.8, 433

[56] References Cited

U.S. PATENT DOCUMENTS 1,501,887 7/1924 Crapo ..... 428/659

1,726,652 9/1929 Crapo ..... 147/220

*Primary Examiner*—John Niebling

*Assistant Examiner*—Edna Wong

*Attorney, Agent, or Firm*—Dvorak and Traub

[57] ABSTRACT

A zinc or zinc-alloy plated steel sheet having an improved weldability and plating properties, as well as a method for making the same is provided. Even when the substrate steel sheet is the one which is difficult to deposit a zinc or zinc-alloy layer by conventional methods, such as an extra low carbon steel sheet, the present invention enables a reliable production of a galvanized steel sheet suffering from no plating failure of insufficient adhesion as well as a reliable production of a galvanized steel sheet suffering from no plating failure or streaking of the alloyed layer. The zinc or zinc-alloy plated steel sheet having improved weldability comprises an extra low carbon steel sheet, an iron-carbon plated layer or a carbon-rich layer generated by diffusion of the iron-carbon plated layer on at least one major surface of the extra low carbon steel sheet, and a zinc or zinc-alloy plated layer on the iron-carbon plated layer or the carbon-rich layer. The zinc or zinc-alloy plated steel sheet having improved weldability and/or plating properties is produced by depositing on the steel sheet an iron-carbon plated layer having a carbon content of from 0.01% by weight to 10% by weight to a coating weight of from 0.01 $g/m^2$ to 10 $g/m^2$, optionally annealing the iron-carbon plated steel sheet, and depositing a zinc or zinc-alloy plated layer, preferably by galvanizing or galvannealing, on the annealed steel sheet.

14 Claims, No Drawings

SURFACE-TREATED STEEL SHEET HAVING IMPROVED WELDABILITY AND PLATING PROPERTIES, AND METHOD FOR PRODUCING THE SAME

This is a divisional of application Ser. No. 07/658,084 filed on Feb. 20, 1994, now U.S. Pat. No. 5,326,648.

BACKGROUND OF THE INVENTION

This invention relates to a steel sheet having a zinc or zinc-alloy plated layer having an improved welding continuity during spot welding.

This invention also relates to a method for producing a surface-treated steel sheets having such improved weldability, as well as a method for producing a surface-treated steel sheet having improved plating properties by which steel sheets such as high tensile strength steel sheets, which are difficult to deposit a plated layer by conventional methods, may be plated without causing any plating failure resulting in bare spot or uncovered area.

Zinc and zinc-alloy plated steel sheets are often used for body of an automobile to prevent rust generation. However, during spot welding of the steel sheets in the assembly of the car body, the zinc or zinc alloy plated layer melts at the interface between the plated layer and copper-based electrode, and the molten metal deposits on the electrode. Consequently, the area through which weldable current passes will be smaller than the case of cold rolled steel sheets without any zinc or zinc-alloy layer. The molten zinc or zinc alloy also erodes the copper-based electrode to damage the electrode, resulting in poor welding continuity. Productivity is thus reduced since change and dressing of the electrode are frequently required.

Various approaches are disclosed to improve the weldability of the zinc or zinc-alloy plated steel sheets. Japanese Patent Application Kokai Nos. 55-110183 and 60-63394 disclose formation of an oxide film such as $Al_2O_3$ on the surface of the zinc or zinc-alloy layer to utilize high melting point and high electric resistance of the oxide for the improvement of weldability. The oxide film also prevents the electrode from contacting with the zinc or zinc alloy, and prevents the melt loss of the electrode to extend the life of the electrode. Japanese Patent Application Kokai No. 02-04983 discloses a heat treatment of the zinc or zinc-alloy plated steel sheet to form an oxide film mainly comprising ZnO on the surface of the plated steel sheet to improve the weldability.

These approaches wherein an oxide film is formed on the zinc or zinc-alloy plated steel sheet have so far failed to achieve sufficient results in an industrial scale. These approaches were also disadvantageous in productivity in the subsequent steps including phosphate treatment and coating, as well as the quality of the resulting product.

Zinc or zinc-alloy plated steel sheets are often used for body of an automobile as mentioned above, and also, for exterior member of home electric appliance. Among the zinc or zinc-alloy plated steel sheets, galvanized steel sheets, especially galvannealed steel sheets, are enjoying a rapidly increasing demand for automobile rust-proof steel sheets owing to their excellent coating adhesion and corrosion resistance after coating.

Nowadays, demand for the galvanized steel sheets have changed with the drift of the trend of society. For example, improvement in fuel economy of the automobile is required in consideration of environmental issues, especially for the reduction of carbon dioxide generation. One of the most effective solution is weight reduction of the car body. In other words, there is an increasing demand for high strength galvannealed steel sheets for an automobile, whose thickness may be reduced without detracting from various physical properties including workability, weldability and corrosion resistance. To meet such a demand, there is required an addition of one or more alloying elements selected from phosphorus, silicon, manganese and chromium which contribute to an improvement in the strength of the steel sheet to an extra low carbon steel sheet having at least one element selected from titanium, niobium and boron added thereto without detracting from the workability of the steel sheet.

The alloying elements such as phosphorus, silicon, and chromium are easily oxidized and difficult to reduce. Therefore, in the annealing step of a continuous galvanizing line, for example, Sendzimir line, these alloying elements frequently form stable oxides on the surface of the steel sheet, and also the alloying elements often segregate underneath the thus formed oxides. These oxides will not be fully reduced even when the steel sheets are annealed in a reducing atmosphere, and the oxides which inconsistently remained will inhibit wetting of the steel sheet surface in the galvanizing after the annealing and cooling of the steel sheet, resulting in a plating failure such as bare spots and, in more serious case, uncovered areas. The inconsistently remained oxide will lead to a significantly reduce adhesion of the plated layer even when no plating failure is induced. In the galvannealing, the inconsistently remained oxides will result in an inconsistent alloying of the plated layer, resulting in uneven plated surface. In more serious case, visually recognizable unevenness commonly referred to as white or black streak will appear on the surface.

Various approaches have been proposed to galvanize or galvanneal these steel sheets, which are difficult to plate, without causing any plating failure, and without causing inconsistent alloying resulting in uneveness or streaking. These approaches employ various pretreatments of the steel sheet surface. Japanese Patent Application Kokai No. 55-43629 discloses deposition of a copper layer on the steel sheet, and Japanese Patent Application Kokai No. 55-131165 discloses deposition of a nickel layer on the steel sheet. Japanese Patent Application Kokai Nos. 57-70268 and 57-79160 disclose deposition of an iron layer on the steel sheet.

These approaches, however, suffer from various problems in their practical uses. When a copper layer is plated on the steel sheet, copper will dissolve into the zinc plating bath to contaminate the zinc bath. When a nickel layer is plated on the steel sheet, nickel will also dissolve into the zinc plating bath to contaminate the zinc bath. Furthermore, in galvannealing, nickel will excessively promote the alloying reaction, and in some extreme cases, alloying may start as early as in the galvanizing step. Consequently, control of the alloying will be quite difficult. In contrast to the copper and nickel plated layers, an iron layer little suffer from the contamination of the zinc plating bath. Iron layer containing iron alone, however, is far from being effective.

SUMMARY OF THE INVENTION

In view of the above-described situation, an object of the present invention is to obviate such situation and provide a surface-treated steel sheet having an excellent weldability as well as chemical conversion properties and coating properties.

Another object of the present invention is to provide a method for reliably producing a zinc or zinc-alloy electroplated or hot dip galvanized high tensile strength steel sheet without suffering from plating failure or insufficient adhesion, and a method for reliably producing a galvannealed high tensile strength steel sheet without suffering from plating failure or streaking by suppressing surface segregation of the alloying elements such as phosphorus, silicon, manganese and chromium included in the high tensile steel sheet and oxidation of the segregated elements.

The inventors of the present invention have investigated various factors influencing the spot weldability of the zinc or zinc-alloy plated steel sheets, and found out that the composition, in particular, the carbon content of the base steel material has a large effect on the spot weldability of the resulting steel sheet, and more illustratively, that lower carbon content results in inferior spot weldability.

Improvement in the spot weldability is seriously required since the carbon content of the substrate steel material of the automobile deep drawing steel sheets, which are subjected to complicated working, is usually extremely low in the range of up to 0.01% by weight.

This extra low carbon content, however, has been determined in consideration of the strength and workability required for the steel sheets, and can not be altered just for improving the spot weldability.

The inventors of the present invention, therefore, made an intense study to increase the spot weldability of the zinc or zinc-alloy plated extra low carbon steel sheets to a level equivalent to that of the zinc or zinc-alloy plated steel sheets wherein higher carbon-content steel sheets are used, without detracting from other properties of the steel substrates, and arrived at the present invention.

The inventors also found that the surface segregation of the alloying elements and oxidation of the segregated elements during the annealing step in the continuous galvanizing line may be quite effectively suppressed by preliminarily depositing an iron-carbon layer having a predetermined carbon content to a predetermined coating weight on the surface of the steel substrate. Consequently, the resulting zinc or zinc alloy hot dipped steel sheet does not suffer from plating failure or insufficient adhesion, and in the case of galvannealing, the resulting galvannealed steel sheet does no suffer from plating failure or inconsistent alloying leading to streaking.

According to the present invention, there is provided a surface-treated steel sheet having improved weldability comprising an extra low carbon steel sheet, an iron-carbon plated layer or a carbon-rich layer generated by diffusion of the iron-carbon plated layer on at least one major surface of the extra low carbon steel sheet, and a zinc or zinc-alloy plated layer on the iron-carbon plated layer or the carbon-rich layer.

The iron-carbon layer may preferably be deposited to a coating weight of from 0.01 g/m$^2$ to 10 g/m$^2$, and the iron-carbon plated layer or the carbon-rich layer may preferably have a carbon content of up to 10% by weight.

The zinc or zinc-alloy layer may preferably be deposited by electroplating, galvanizing, or galvannealing.

According to the present invention, there is also provided a method for producing a surface-treated steel sheet having improved weldability and/or plating properties wherein an iron-carbon layer having a carbon content of from 0.01% by weight to 10% by weight is deposited on the steel sheet to a coating weight of from 0.01 g/m$^2$ to 10 g/m$^2$, and a zinc or zinc-alloy layer is deposited on the iron-carbon plated layer.

An annealing may be effected before the deposition of the zinc or zinc-alloy plated layer.

The zinc or zinc alloy plated layer may preferably be deposited by galvanizing, galvannealing or electroplating.

The steel sheet may preferably be an extra low carbon steel sheet.

DESCRIPTION OF THE INVENTION

The present invention is hereinafter described in further detail.

First, the surface-treated steel sheet having improved weldability is described.

The steel sheets employed in the present invention are, in particular, extra low carbon steel sheets containing less than 0.01% by weight of carbon since the extra low carbon steel sheet, when plated with zinc or zinc alloy, exhibits quite poor spot weldability, and there is at present a strong demand for the improvement of the spot weldability. The steel sheet used in the present invention, however, is not limited with regard to its composition other than the carbon content.

The layer plated on the steel sheet is limited to zinc or zinc alloy layer since the present invention is particularly effective for improving the weldability of the zinc or zinc-alloy plated steel sheets.

The reason is that, during the spot welding, a zinc alloy is formed on the electrode due to contact of the molten plated zinc or zinc-alloy layer and the electrode, and the poor spot weldability of the zinc or zinc-alloy plated steel sheets is estimated to result from low melting point of the thus formed zinc alloy on the electrode.

The zinc layer may be formed by zinc electroplating, galvanizing, or vapor deposition of zinc. The zinc-alloy layer may be formed by such means as electroplating of zinc alloys such as zinc-nickel alloy, zinc-manganese alloy, zinc-chromium alloy, and zinc-iron alloy; galvannealing; hot dipping of zinc alloys such as zinc-aluminum alloy; and vapor deposition of zinc alloys between zinc and other elements. Two-layered platings wherein another iron-based or zinc-based plated layer is deposited over the zinc or zinc-alloy layer are also within the scope of the present invention. The zinc or zinc-alloy plated layer may also contain fine particles of ceramics such as $SiO_2$, $Al_2O_3$, and $TiO_2$ and/or organic high polymers dispersed therein.

As set forth above, electrodes are easily consumed during welding of the conventional steel sheets having the low-melting zinc or zinc-alloy layer plated thereon. In the present invention, the life of the electrode during welding of the zinc or zinc-alloy plated steel sheets is prolonged by depositing a thin iron-carbon plated layer between the steel substrate and the zinc or zinc-alloy layer.

For realizing such effects, the iron-carbon plated layer may have a carbon content of at least 0.01% by weight. The effect will be saturated at a carbon content of 10% by weight, and no further improvement will be achieved by adding more than 10% of carbon.

The iron-carbon plated layer will be effective when it is deposited to a coating weight of at least 0.01 g/m$^2$. The effects will be saturated at 10 g/m$^2$, and a deposition of the iron-carbon layer to a coating weight of more than 10 g/m$^2$ will result in deteriorated productivity because the period required for the deposition of the iron-carbon layer will be unnecessarily long without any further effects being achieved.

The deposition of the iron-carbon layer between the steel sheet substrate and the zinc or zinc-alloy layer may be carried out by either wet process such as electroplating or by dry process such as vapor deposition. Electroplating, however, is suitable for treating the steel sheet in the production line within a relatively short period. When the zinc or zinc-alloy layer is provided by hot dipping, the iron-carbon layer may be deposited either before or after an annealing of the steel sheet, and thereafter, the zinc or zinc-alloy may be deposited on the iron-carbon layer.

Next, the method for producing a surface-treated steel strip having improved weldability and/or plating properties is described. Although the steel sheet is mainly galvanized or galvannealed in the following description, it is to be understood that the present invention is not limited to these processes but also includes electroplating of zinc and zinc alloys and deposition of zinc and zinc alloys by other means. A zinc or zinc-alloy plated steel sheet further comprising an overlying organic coating is also within the scope of the invention.

The steel sheets which may be employed in the present method are not limited to any particular type. The present method, however, is particularly effective for steel sheets which are difficult to galvanize, including those steel sheets having added thereto such alloying elements as phosphorus, silicon, manganese, chromium, and aluminum, which adversely affect the galvanizing. The present method is most effective for extra low carbon steel sheets including at least one member selected from titanium, boron and niobium, and having phosphorus, silicon, and manganese added thereto, which are high tensile strength steel sheets nowadays frequently used as deep drawing rust preventive steel sheets for automobile applications.

In the present invention, an iron-based layer containing 0.01 to 10% by weight of carbon is deposited to a coating weight of 0.01 to 10 g/m$^2$ on the surface of the steel sheet, which is difficult to galvanize, and thereafter, a zinc or zinc-alloy layer is deposited on the iron-based layer, for example, in a continuous galvanizing line to produce a galvanized or galvannealed steel sheet.

The term, galvanized steel sheet used herein designates the steel sheet which has been hot dipped in a bath containing 0.01 to 60% by weight of aluminum, and the bath may include up to 2% by weight of lead, antimony, tin, magnesium, bismuth, silicon, and the like for such purposes as adjustment of spangles. The term galvannealed steel sheet used herein designates the steel sheet which has been hot dip galvanized in a bath containing up to 0.2% by weight of aluminum, and immediately after the galvanizing, annealed by heating the galvanized steel sheet to a predetermined temperature for a predetermined period in an alloying furnace to alloy the galvanized layer into a zinc-iron alloy containing 8 to 12% by weight of iron. The bath used in galvannealing may also contain up to 2% by weight of lead, antimony, tin, magnesium, bismuth, silicon, and the like.

The carbon in the iron-carbon layer of the present invention is critical for preventing various alloying elements included in the steel substrate from segregating to the surface of the steel substrate during the annealing step, and preventing the thus segregated elements from being oxidized. An iron layer free of carbon can not prevent the surface segregation of such elements as phosphorus, silicon and chromium, which are estimated to be most relevant to the plating failure resulting in bare spots and uncovered areas. The action of the carbon in the iron-carbon layer or the carbon-rich layer produced by the annealing of the steel sheet having the iron-carbon layer is not yet theoretically fully revealed. However, it is estimated that the carbon in the iron-carbon layer or the carbon-rich layer acts either as a barrier for the diffusion of various alloying elements in the steel substrate, or as a reducing agent to reduce oxygen pressure in the vicinity of the steel sheet surface to thereby prevent the surface segregation of various alloying elements and oxidation of the segregated elements. It is to be noted that, for the purpose of solely improving the weldability, it is only necessary to form the iron-carbon layer on the steel substrate, and the conversion of the iron-carbon layer into the carbon-rich layer by annealing is not necessarily required.

The iron-based layer containing carbon, namely, the iron-carbon layer may further include, in addition to the iron and the carbon, at least one additional element selected from phosphorus, boron, sulfur, oxygen, zinc, manganese, magnesium, tungsten, molybdenum, nickel, cobalt, chromium, copper, titanium, vanadium, tin, antimony, arsenic, lead, indium, calcium, barium, strontium, silicon, aluminum, and bismuth. These additional elements will not inhibit the effects of the present invention so long as they are included in total amount of up to 10% by weight.

As described above, the iron-carbon layer containing 0.01 to 10% by weight of carbon is deposited to a coating weight of 0.01 to 10 g/m$^2$. When the carbon content is less than 0.01% by weight and the coating weight is less than 0.01 g/m$^2$, the resulting hot dip galvanized steel strip will suffer from plating failure as well as insufficient adhesion of the plated layer, and in the case of galvannealing, the resulting galvannealed steel strip will suffer from plating failure and streaking rendering the plated zinc-alloy layer ineffective. On the other hand, when the carbon content is in excess of 10% by weight and the coating weight is in excess of 10 g/m$^2$, the effects will be saturated and the production cost will be uneconomically increased. For practicing a stable and economical operation, a coating weight in the range of from 1 to 5 g/m$^2$, and a carbon content in the range of from 0.5 to 5% by weight is more preferable.

The iron-carbon layer of the present invention may be deposited on the steel substrate by electroplating including molten salt electroplating, electroless plating, ion plating, vapor deposition, and the like. Among these, the electroplating from an aqueous solution is suitable for the practice of the present invention for its ability to deposit a consistent layer over the surface of the steel strip at high efficiency, and ease of incorporation into the production line. In this case, the bath may be either a chloride bath or a sulfate bath containing iron ion, or a mixture thereof. The carbon in the iron-carbon layer may be supplied by adding trisodium citrate, sucrose and other soluble sugars, glycerine, or higher alcohols to the plating solution.

The iron-carbon layer may be deposited either in the production line before the heating of the steel sheet in the continuous galvanizing system, or off the production line, the former being more preferable for its low production cost. It is to be noted that use of a flux is also effective in the production of hot dip galvanized steel sheets or galvannealed steel sheets with no annealing step.

The zinc or zinc-alloy plated steel sheet of the present invention has improved corrosion resistance due to the zinc or zinc-alloy layer since the product of the present invention has no plating failure. The galvannealed steel sheets, which are frequently used as rust-preventive steel sheets for automobiles, must have improved workability, spot weldability, chemical conversion properties, coating properties, and corrosion resistance. The galvannealed steel sheets produced in accordance with the present invention is either equivalent or superior in all of the above-mentioned properties compared to the conventional galvannealed steel sheets using low strength steel sheets. In particular, the spot weldability is markedly improved in the present invention even when extra low carbon steel sheets are employed. Further, the workability and the chemical conversion properties of the resulting product may further be improved by depositing a layer of iron alloy such as iron-zinc, iron-phosphorus, iron-manganese, and iron-boron on the galvannealed steel strip of the present invention.

The present invention is hereinafter described in further detail by referring to Examples.

EXAMPLE 1

Both annealed and unannealed extra low carbon steel sheets containing 0.002% by weight of carbon having a thickness of 0.7 mm were degreased and pickled in a manner commonly used in the pretreatments for electroplating.

FORMATION OF IRON-CARBON LAYER

The thus pretreated steel sheets were electroplated under the following conditions to form an iron-carbon layer. The carbon content of the iron-carbon layer was varied by adding different amounts of trisodium citrate to the bath. The coating weight of the iron-carbon layer was varied by changing the duration of the electroplating.

| | |
|---|---|
| Bath | |
| $FeCl_2.nH_2O$ | 200 g/l |
| trisodium citrate dehydrate | up to 100 g/l |
| 60° C., pH 1.5 | |
| Plating conditions | |
| Current density | 50 A/dm$^2$ |

After the deposition of the iron-carbon layer, the steel sheet was washed with water and dried.

Next, a zinc or zinc alloy layer was deposited as described below.

| | |
|---|---|
| [Electroplating of zinc layer] | |
| Bath | |
| $ZnCl_2$ | 200 g/l |
| KCl | 200 g/l |
| pH 4 | |
| Bath temperature | 60° C. |
| Coating weight | 70 g/m$^2$ |
| [Electroplating of zinc-nickel layer] | |
| Bath | |
| $ZnCl_2$ | 300 g/l |
| $NiCl_2.6H_2O$ | 85 g/l |
| KCl | 350 g/l |
| pH 4.5 | |
| Bath temperature | 60° C. |
| Coating weight | 30 g/m$^2$ |

-continued

| | |
|---|---|
| Ni content in the Zn—Ni layer | 12.5% by weight |

GALVANIZING

Annealing Before Galvanizing

Temperature increased at: 10° C./sec
Heated to: 850° C. for 30 sec
Temperature decreased at: 20° C./sec
Atmosphere in the oven: $N_2$+15% $H_2$
(Dew point, 0° C.)

Galvanizing

Bath temperature: 470° C.
Al content: 0.20% by weight
Coating weight: 100 g/m$^2$ (per single surface)

GALVANNEALING

Annealing Before Galvanizing

The annealing was carried out as in the galvanizing.

Galvanizing

Bath temperature: 470° C.
Al content: 0.15% by weight
Coating weight: 45 g/m$^2$ (per single surface)

Heat Treatment for Alloying

Alloying temperature: 480° C.
Alloying period: 10 to 50 sec
Fe content in the plated layer: 10% by weight,
The Fe content was adjusted by varying the alloying period The thus produced surface treated steel sheets were evaluated for their spot weldability and water-resistant secondary adhesion as described below.

WELDABILITY

The surface treated steel sheets were welded under the following conditions.

Electrode

Type: CF
Tip diameter: 4.5 mm
Tip angle: 120°
Outer diameter: 13 cm
Material: Cu—Cr Welding Conditions Welding current: 8.8 kA
Current application period: 10 cycles
Welding force: 170 kgf Pressure Application Before current application: 30 cycles
After current application: 7 cycles
No up-down slopes The spot welding was continuously carried out under the above-mentioned conditions, and the spot weldability was evaluated as the average of the number of spots at which diameter of the nugget formed became 4.5 $\sqrt{t}$ provided that t represents the thickness of the steel sheet welded.

The results are shown in Table 1.

WATER-RESISTANT SECONDARY ADHESION

Sample sheets of 70 mm × 150 mm × 0.7 mm thickness were coated as described below to resemble the production line of car bodies.

(1) Zinc phosphate conversion

Zinc phosphate conversion was carried out by using a treating solution purchased under the trade name of Palbond L3020 from Nihon Parkerizing Co., Ltd.

(2) Cation electrodeposition coating

Cation electrodeposition coating was carried out at 250 V by using a coating composition purchased under the trade name of Powertop U-100 from Nippon Paint Co. Ltd. to a thickness of 20 μm.

(3) Intermediate coat

Intermediate coat was applied by using an intermediate coating composition for automobile manufactured by Kansai Paint Co., Ltd. to a thickness of 35 to 40 μm.

(4) Top coat

Top coat was applied by using a coating composition for automobile manufactured by Kansai Paint Co., Ltd. to a thickness of 35 to 40 μm.

After the application of the top coat, the steel sheet samples were immersed in deionized water at a temperature of 50° C. for 240 hours, and a cross cut adhesion test was carried out immediately after the removal of the samples from the deionized water. The cross cut adhesion test was carried out by making cross cuts at a regular interval of 2 mm, applying an adhesion tape onto the cross cut sample, and peeling the adhesion tape off the sample, counting the number of squares wherein 50% or more of the coating is left, and dividing the number of such squares by the total number of the squares to obtain coating residual rate in percentage.

The results are shown in Table 1.

Along with the results of the Examples of the present invention wherein an iron-carbon layer is deposited, the results of Comparative Examples with no iron-carbon layer is shown in Table 1. When the surface-treated steel sheets free of the iron-carbon layer were spot welded, the electrodes were damaged significantly earlier than the steel sheets of the Examples irrespective of the method used for the deposition of the zinc or zinc-alloy layer. The life of the electrodes were markedly elongated by providing an iron-carbon layer between the base material and the zinc or zinc-alloy layer.

TABLE 1

| | Fe—C layer | | | | No. of spots | Water-resistant adhesion |
|---|---|---|---|---|---|---|
| | Coating weight, g/m² | C content, wt % | Zn or Zn alloy layer | Overlying layer | in continuous Welding | |
| CE 1 | — | — | Zn EP | — | 400 | 100 |
| CE 2 | 1 | 0 | Zn EP | — | 400 | 100 |
| E 1 | 1 | 0.01 | Zn EP | — | 3000 | 100 |
| E 2 | 1 | 0.1 | Zn EP | — | 5000 | 100 |
| E 3 | 1 | 5 | Zn EP | — | 5500 | 100 |
| CE 3 | — | — | Zn-Ni EP | — | 2000 | 100 |
| E 4 | 1 | 0.1 | Zn—Ni EP | — | 5000 | 100 |
| E 5 | 3 | 0.1 | Zn—Ni EP | — | 6000 | 100 |
| CE 4 | — | — | galvanizing | — | 200 | 100 |
| E 6 | 1 | 0.1 | galvanizing | — | 2000 | 100 |
| CE 5 | — | — | galvannealing | — | 800 | 100 |
| E 7 | 0.01 | 1 | galvannealing | — | 4500 | 100 |
| E 8 | 1 | 1 | galvannealing | — | 6000 | 100 |
| E 9 | 5 | 1 | galvannealing | — | 6500 | 100 |
| CE 6 | — | — | galvanneal- | ZnO* | 5000 | 50 |

TABLE 1-continued

| | Fe—C layer | | | | No. of spots | Water-resistant adhesion |
|---|---|---|---|---|---|---|
| | Coating weight, g/m² | C content, wt % | Zn or Zn alloy layer | Overlying layer | in continuous Welding | |
| | | | ing | | | |

CE: Comparative Example
E: Example
EP: electroplating
*The test sample of Comparative Example 6 was prepared by heating the galvannealed steel sheet of Comparative Example 5 in a furnace with a dew point of 30° C. for 400° C. × 5 sec.

EXAMPLE 2

A molten steel containing 0.002% by weight of carbon, 1.0% by weight of silicon, 3.0% by weight of manganese, and 0.15% by weight of phosphorus was prepared, and subjected to conventional hot rolling and cold rolling to produce a steel sheet having a thickness of 0.7 mm. The cold rolled steel sheet was degreased and activated by using hydrochroric acid. The thus prepared steel sheet was electroplated to form an iron-carbon layer on the steel substrate, annealed, and galvanized in the same manner as Example 1.

The resulting galvanized steel sheets were evaluated for their appearance, adhesion, and corrosion resistance as described below. The results are shown in Table 2.

Appearance

Appearance was evaluated by visual inspection.
good: no bare spot or uncovered area
poor: with bare spots or uncovered areas

Adhesion

Adhesion was evaluated by DuPont impact adhesion test.
good: no peeling
poor: peeled

Corrosion Resistance

Corrosion resistance was evaluated by salt spray test according to JIS Z2371
good: no red rust generated before 100 hrs.
poor: red rust generated before 100 hrs.

TABLE 2

| No. of Experiment | Fe—C layer Coating weight, g/m² | Fe—C layer C content, wt % | Appearance | Test results Adhesion | Test results Corrosion resistance |
|---|---|---|---|---|---|
| 1* | — | — | poor | poor | poor |
| 2** | 0.008 | 2 | poor | poor | poor |
| 3** | 3 | 0.008 | poor | poor | poor |
| 4 | 0.01 | 2 | good | good | good |
| 5 | 0.1 | 2 | good | good | good |
| 6 | 5 | 2 | good | good | good |
| 7 | 10 | 2 | good | good | good |
| 8 | 3 | 0.01 | good | good | good |
| 9 | 3 | 0.1 | good | good | good |
| 10 | 3 | 5 | good | good | good |
| 11 | 3 | 10 | good | good | good |

*Comparative Example, conventional product with no Fe—C layer.
**Comparative Example, the underlined value is outside the range of the present invention.

The data in Table 2 reveal that the galvanized steel sheets produced by the method of the present invention exhibit no bare spot or uncovered area, and has good adhesion properties as well as improved corrosion resistance.

EXAMPLE 3

The steel material of Example 2 was rolled, electroplated to form the iron-carbon layer, and annealed in the same manner as Example 2. The steel sheet was then galvanized and heat treated for alloying in the same manner as Example 1 to produce galvannealed steel sheets.

The resulting galvannealed steel sheets were evaluated for their appearance, adhesion of the plated layer, as well as spot weldability, water-resistant secondary adhesion, and corrosion resistance as described below.

Appearance

Appearance was evaluated by visual inspection.

good: no bare spot or uncovered area
poor: with bare spots or uncovered areas

Adhesion

Adhesion of the plated layer to the substrate steel sheet was evaluated by bending the test sample to 90° and straightening it again.

good: little peeling
poor: considerable peeling

Weldability

Weldability was evaluated in the same manner as Example 1.

good: number of spots in the continuous welding of 3,000 or more
poor: number of spots in the continuous welding of less than 3,000

Water-resistant Secondary Adhesion

Water-resistant secondary resistance was evaluated in the same manner as Example 1.

good: coating residual percentage of 100%
poor: coating residual percentage of less than 100%

Corrosion Resistance

Corrosion resistance was evaluated by salt spray test. The coated steel sheet was prepared as in the evaluation of the water-resistant secondary adhesion. A scratch was made on one surface of the coated steel sheet to reach the substrate steel. Corrosion test was carried out for 300 days by repeating the cycles each comprising spraying of brine at 35° C. for 30 min., drying at 60° C. for 2.5 hrs., moistening at 40° C. and at relative humidity of 95% for 2.5 hrs., and drying at 60° C. for 2.5 hrs. The corrosion resistance was evaluated by the width of the scab developed from the scratch.

good: scab width of less than 3 mm
poor: scab width of 3 mm or more

The results are shown in Table 3.

TABLE 3

| No. of Experiment | Fe—C layer Coating weight, g/m² | Fe—C layer C content, wt % | Test Results Appearance | Adhesion | Weldability | Water-resistant secondary adhesion | Corrosion resistance |
|---|---|---|---|---|---|---|---|
| 1* | — | — | poor | poor | poor | poor | poor |
| 2** | 0.008 | 2 | poor | poor | good | good | poor |
| 3** | 3 | 0.008 | poor | poor | poor | good | poor |
| 4 | 0.01 | 2 | good | good | good | good | good |
| 5 | 0.1 | 2 | good | good | good | good | good |
| 6 | 5 | 2 | good | good | good | good | good |
| 7 | 10 | 2 | good | good | good | good | good |
| 8 | 3 | 0.01 | good | good | good | good | good |
| 9 | 3 | 0.1 | good | good | good | good | good |
| 10 | 3 | 5 | good | good | good | good | good |
| 11 | 3 | 10 | good | good | good | good | good |

*Comparative Example, conventional product with no Fe—C layer.
**Comparative Example, the underlined value is outside the range of the present invention.

The results shown in Table 3 reveal that the galvannealed steel sheets prepared by the method of the present invention exhibit no bare spots or uncovered area, and have improved adhesion to result in excellent powdering resistance. The galvannealed steel sheets prepared by the method of the present invention also showed improved spot weldability and corrosion resistance.

EXAMPLE 4

Example 3 was repeated except that the iron-carbon layer was replaced with an iron-carbon layer containing phosphorus, boron, sulfur, and zinc.

The iron-carbon layer containing phosphorus, boron, sulfur, and zinc was prepared by adding sodium hypophosphite, sodium methaborate, sodium thiocyanate, and zinc chloride to the plating bath described in Example 2 in amounts of 2, 2, 1, and 5% by weight calculated as phosphorus, boron, sulfur, and zinc, respectively.

The thus obtained galvannealed steel sheets were evaluated as in Example 3. The results are shown in Table 4.

TABLE 4

| No. of Experiment | Fe—C layer containing P, B, S and Zn Coating weight, g/m² | Fe—C layer containing P, B, S and Zn C content, wt % | Test Results Appearance | Adhesion | Weldability | Water-resistant secondary adhesion | Corrosion resistance |
|---|---|---|---|---|---|---|---|
| 1* | — | — | poor | poor | poor | poor | poor |
| 2** | 0.008 | 2 | poor | poor | good | good | poor |
| 3** | 3 | 0.008 | poor | poor | poor | good | poor |
| 4 | 0.01 | 2 | good | good | good | good | good |

TABLE 4-continued

| No. of Experiment | Fe—C layer containing P, B, S and Zn: Coating weight, g/m² | C content, wt % | Test Results: Appearance | Adhesion | Weldability | Water-resistant secondary adhesion | Corrosion resistance |
|---|---|---|---|---|---|---|---|
| 5 | 0.1 | 2 | good | good | good | good | good |
| 6 | 5 | 2 | good | good | good | good | good |
| 7 | 10 | 2 | good | good | good | good | good |
| 8 | 3 | 0.01 | good | good | good | good | good |
| 9 | 3 | 0.1 | good | good | good | good | good |
| 10 | 3 | 5 | good | good | good | good | good |
| 11 | 3 | 10 | good | good | good | good | good |

*Comparative Example, conventional product with no Fe—C layer.
**Comparative Example, the underlined value is outside the range of the present invention.

The results of Table 4 reveal that the effects of the present invention is not suppressed when total content of phosphorus, boron, sulfur and zinc is up to 10% by weight.

EXAMPLE 5

The steel material of Example 2 was rolled, electroplated to form the iron-carbon layer, and annealed in the same manner as Example 2. The steel sheet was then electroplated in the same manner as Example 1 to produce zinc-nickel electroplated steel sheets.

The resulting zinc-nickel electroplated steel sheets were evaluated for their adhesion of the plated layer and corrosion resistance in the same manner as Example 2.

TABLE 5

| No. of Experiment | Fe—C layer: Coating weight, g/m² | C content, wt % | Test results: Adhesion | Corrosion resistance |
|---|---|---|---|---|
| 1* | — | — | poor | poor |
| 2** | 0.008 | 2 | poor | poor |
| 3** | 3 | 0.008 | poor | poor |
| 4 | 0.01 | 2 | good | good |
| 5 | 0.1 | 2 | good | good |
| 6 | 5 | 2 | good | good |
| 7 | 10 | 2 | good | good |
| 8 | 3 | 0.01 | good | good |
| 9 | 3 | 0.1 | good | good |
| 10 | 3 | 5 | good | good |
| 11 | 3 | 10 | good | good |

*Comparative Example, conventional product with no Fe—C layer.
**Comparative Example, the underlined value is outside the range of the present invention.

The data presented in Table 5 reveal that the zinc-nickel plated steel sheets according to the present invention have improved adhesion as well as corrosion resistance.

As described above, weldability of the extra low carbon steel sheets plated with a zinc or zinc alloy layer with a zinc content of at least 70% by weight is remarkably improved without detracting from chemical conversion properties and coating properties.

Furthermore, even when various alloying elements are added to the extra low carbon steel sheets to render the galvanizing difficult, reliable production of the zinc or zinc-alloy plated steel sheets having improved properties may be enabled by employing the method of the present invention. In particular, the fact that the present invention has enabled a reliable production of high-strength zinc or zinc-alloy plated steel sheets, which is critical for weight reduction of automobiles, is of much significance.

We claim:

1. A method for producing a surface-treated steel sheet having at least one of an improved weldability and plating properties comprising the steps of depositing on a steel sheet an iron-carbon plated layer having a carbon content of from 0.01% by weight to 10% by weight to a coating weight of from 0.01 g/m² to 10 g/m², and depositing a zinc or zinc alloy plated layer on the iron-carbon plated layer.

2. A method for producing a surface-treated steel sheet having at least one of an improved weldability and plating properties comprising the steps of depositing on the steel sheet an iron-carbon plated layer having a carbon content of from 0.01% by weight to 10% by weight to a coating weight of from 0.01 g/m², annealing the iron-carbon plated steel sheet, and depositing a zinc or zinc-alloy plated layer on the annealed steel sheet.

3. The method according to claim 1 wherein the zinc or zinc-alloy layer is deposited by galvanizing.

4. The method according to claim 1 wherein the zinc or zinc-alloy layer is deposited by galvannealing.

5. The method according to claim 1 wherein the zinc or zinc-alloy layer is deposited by electroplating.

6. The method according to claim 1 wherein the steel sheet is an extra low carbon steel sheet containing up to 0.01% by weight of carbon.

7. The method according to claim 2 wherein the zinc or zinc-alloy layer is deposited by galvanizing.

8. The method according to claim 2 wherein the zinc or zinc-alloy is deposited by galvannealing.

9. The method according to claim 2 wherein the zinc or zinc-alloy is deposited by electroplating.

10. The method according to claim 2 wherein the steel sheet is an extra low carbon steel sheet containing up to 0.01%, by weight of carbon.

11. The method according to claim 1, wherein the steel sheet is a high tensile strength steel sheet which is an extra low carbon steel sheet containing up to 0.01% by weight of carbon and having phosphorous, silica and manganese added thereto.

12. The method according to claim 1, wherein the steel sheet is a steel sheet difficult to galvanize and having added thereto at least one alloying element selected from the group consisting of phosphorous, silicon, manganese, chromium and aluminum.

13. The method according to claim 2, wherein the steel sheet is a high tensile strength steel sheet which is an extra low carbon steel sheet containing up to 0.01% by weight of carbon and having phosphorous, silica and manganese added thereto.

14. The method according to claim 2, wherein the steel sheet is a steel sheet difficult to galvanize and having added thereto at least one alloying element selected from the group consisting of phosphorous, silicon, manganese, chromium and aluminum.

* * * * *

UNITED STATES PATENT AND TRADEMARK OFFICE

CERTIFICATE OF CORRECTION

PATENT NO. : 5,421,969

DATED : June 6, 1995

INVENTOR(S) : Chiaki Kato, et al

It is certified that error appears in the above-indentified patent and that said Letters Patent is hereby corrected as shown below:

Column 14,

Claim 2, Line 7, after "0.01 $g/m^2$", insert --to 10 $g/m^2$--.

Signed and Sealed this

Thirtieth Day of April, 1996

*Attest:*

*Attesting Officer*

BRUCE LEHMAN

*Commissioner of Patents and Trademarks*